United States Patent [19]

Tani

[11] 3,979,044

[45] Sept. 7, 1976

[54] CARTON CONSTRUCTION

[76] Inventor: Masuzo Tani, No. 19-9, 2-chome, Minami Umagome, Ota, Tokyo, Japan

[22] Filed: Apr. 17, 1975

[21] Appl. No.: 568,821

[30] Foreign Application Priority Data

Jan. 13, 1975 Japan ..... 50-6147

[52] U.S. Cl. ..... 229/17 R; 229/44 R

[51] Int. Cl.[2] ..... B65D 5/72; B65D 5/54

[58] Field of Search ..... 229/7 R, 17 R, 51 D, 229/44 R, 39 R, 38; 222/556

[56] References Cited

UNITED STATES PATENTS

| | | | |
|---|---|---|---|
| 1,305,707 | 6/1919 | Furste | 229/44 R |
| 2,028,687 | 1/1936 | Read | 229/17 R |
| 2,104,195 | 1/1938 | Groeling | 229/44 R X |
| 2,523,668 | 9/1950 | Read | 229/17 R |
| 3,153,504 | 10/1964 | Mischel et al. | 229/44 R X |
| 3,498,524 | 3/1970 | Braun | 229/38 |
| 3,747,833 | 7/1973 | Robinson | 229/51 D |

*Primary Examiner*—Davis T. Moorhead

*Attorney, Agent, or Firm*—Fleit & Jacobson

[57] ABSTRACT

The invention relates to a carton, particularly constructed so as to be mass produced by an automatic carton manufacturing machine. The carton comprises four side portions, each of which contain, on each end of the side portions, a flap portion. The flap portions are constructed to form the two ends of the cartons. Each of the flap portions has a unique shape, such that when they are sequentially folded on top of each other, the flap members form a locking arrangement. This enables one side portion of the carton to be opened and closed a fixed distance, said movable side portion being interlocked with another side portion of the carton.

3 Claims, 8 Drawing Figures

FIG. 4
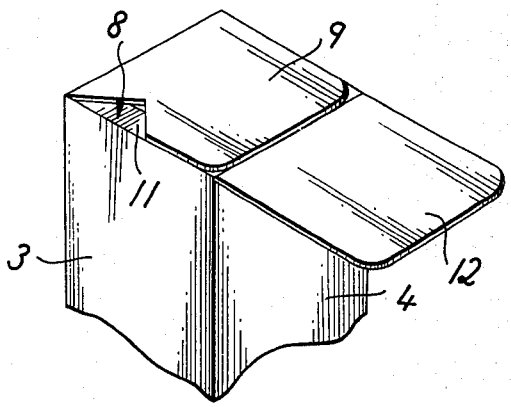
FIG. 5
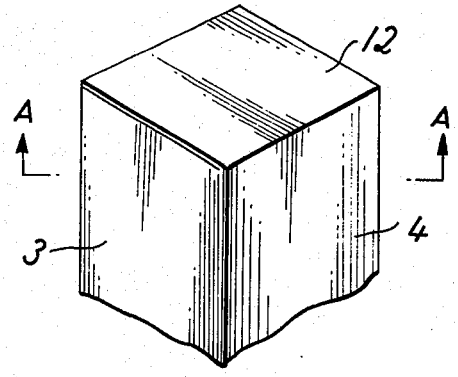
FIG. 6
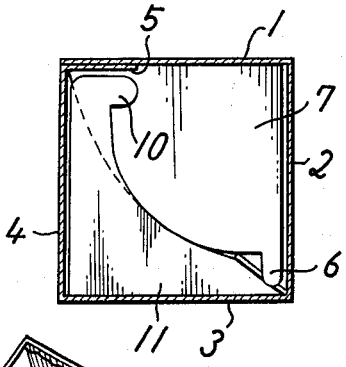
FIG. 8
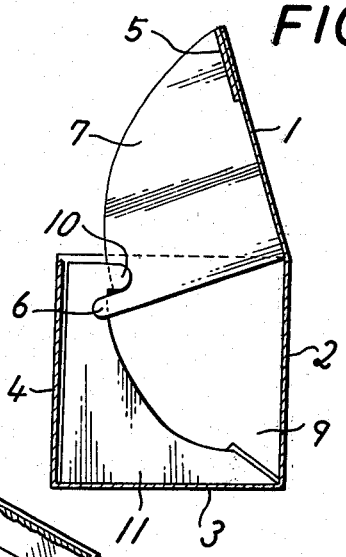
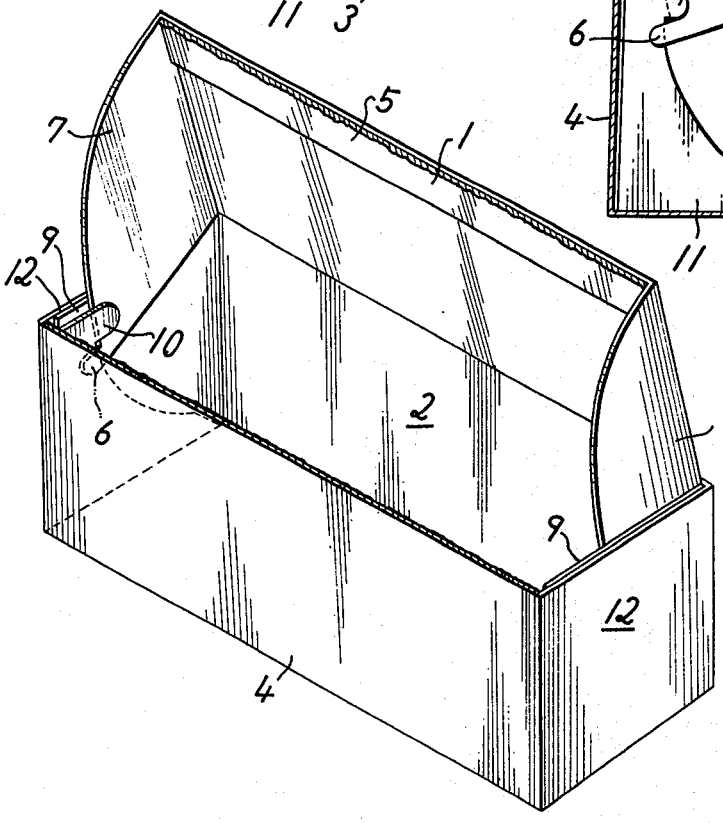
FIG. 7

CARTON CONSTRUCTION

BACKGROUND AND SUMMARY OF THE INVENTION

Various carton constructions equipped with an opening and closing side portion have been developed. However, a mass production of such cartons by automatic carton manufacturing machines has been difficult because of the complicated construction of the cartons.

It is an object of this invention to provide a novel technique to avoid this conventional defect. It is further an object of this invention to provide a carton which enables the locking portion of a support connected to a side panel to interconnect with a locking portion of another panel automatically during the carton construction.

BRIEF DESCRIPTION OF THE DRAWINGS

FIG. 2, FIG. 3 and FIG. 4 are, respectively, successive views showing the steps taken in the construction of the carton.

FIG. 5 is a partial oblique projection view after completing the construction.

FIG. 6 is a sectional view along A—A of FIG. 5.

FIG. 7 is an oblique projection view which shows the condition of said carton upon opening.

FIG. 8 is a sectional view of the carton in FIG. 7.

DETAILED DESCRIPTION OF THE DRAWINGS

A detailed description of the invention will be described in reference to the drawings.

Figure 1:
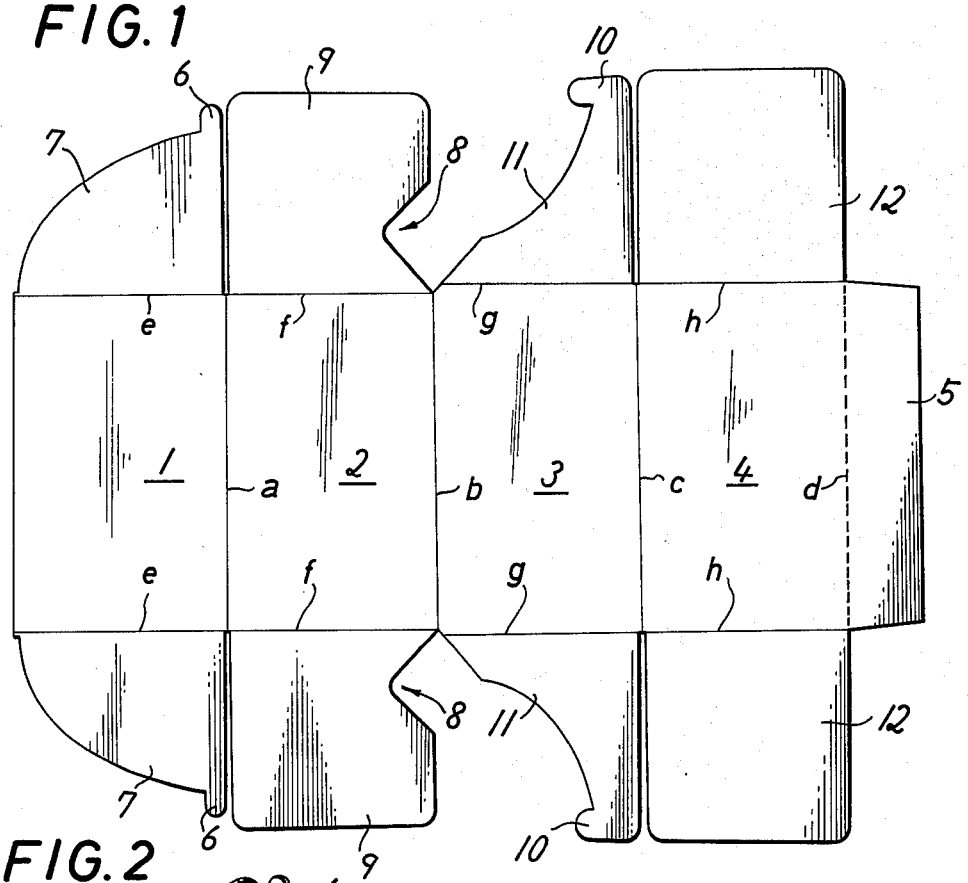
FIG. 1 is a plan view of the carton construction according to this invention.

FIG. 1 shows side panels 1, 2, 3 and 4, each of which form a side of a carton when folded along edges a, b and c. Attached to side panel 4 is a connecting panel 5, which includes a paste for adhesion purposes thereon. The connecting panel 5 is attached to side panel 4 at a perforated line d. Side panels 3 and 4, and connecting panel 5 are all of equal width. That is, the distance between the edges g in side panel 3 is equal to the distance between the edges h in side panel 4. The side panels 1 and 2 are also equal in width. That is, the distance between the edges e in side panel 1 is equal to the distance between the edges f in side panel 2. Note however, that the widths of side panels 1 and 2 are slightly less than the widths of side panels 3 and 4, for a purpose to be described herein.

Attached to each end of each side panel are flaps 7, 9, 11 and 12. These flaps, when folded in a manner as indicated herein, form the ends of the carton. Each of the flaps has a unique shape which is designed to cooperate with each other to form a novel locking arrangement.

Hingedly connected at each end of side panel 1, at folding edges *e*, are fan-shaped supporting flaps 7. Supporting flaps 7 are fan-shaped convex flaps having a projection 6 located at the point where the convex portion meets with the edge of the flap 7 that extends from the fold line *a*. The projection 6 is thus located at the outermost portion of the convex edge from the hinged connection.

Hingedly connected at each end of side panel 2, at folding edges *f*, are lower cover flaps 9. Lower cover flaps 9 are substantially square, or rectangular, with two sideways cuts forming a V-shape 8 at one side of the flap. One sideways cut of the V-shape 8 intersects at the point formed by edges *b* and *f*.

Connected at each end of side panel 3, at folding edges *g*, are locking flaps 11. Locking flaps 11 comprise protruding locking projections 10, corresponding in shape to projections 6 of supporting flaps 7, a concave shaped edge 13 extending from said projection 6, and an angle portion 14 formed by a cut intersecting the point formed by edges *b* and *f*.

Connected at each end of side panel 4, at folding edges *h*, are upper cover flaps 12. The upper cover flaps 12 are substantially square, or rectangular.

Figure 3:
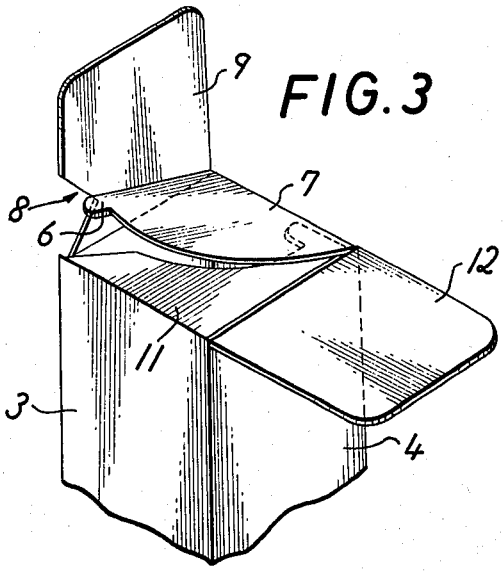

Projections 6 of said supporting flaps 7 and the angle portions 14 of said locking flaps 11, are formed such that said projections 6 of supporting flaps 7 may meet with angle portion 14 of the locking flap 11 when supporting flap 7 is folded over locking flap 11 as shown in FIG. 3. The projections 6 do not collide against said locking flap 11 when said supporting flaps 7 and said locking flap 11 are respectively folded and overlapped during the carton construction.

The supporting flaps 7 and locking flaps 11 are designed such that projections 6 of supporting flaps 7 may slide smoothly along the edges of the curves 13 in the locking flaps 11.

Lower cover flaps 9 are folded over the locking flaps 11 and the supporting flaps 7, as shown in FIG. 4. The lower cover flaps 9 press said locking flap 11 strongly against the center of the carton when said lower cover flaps 9 are folded onto said locking flap 11. The angle portions 14 of said locking flap 11 are adjacent the edge portions of V-shaped cuts 8 so that said locking flap 11 and lower cover flap 9 do not overlap each other at angle portion 14.

Figure 2:
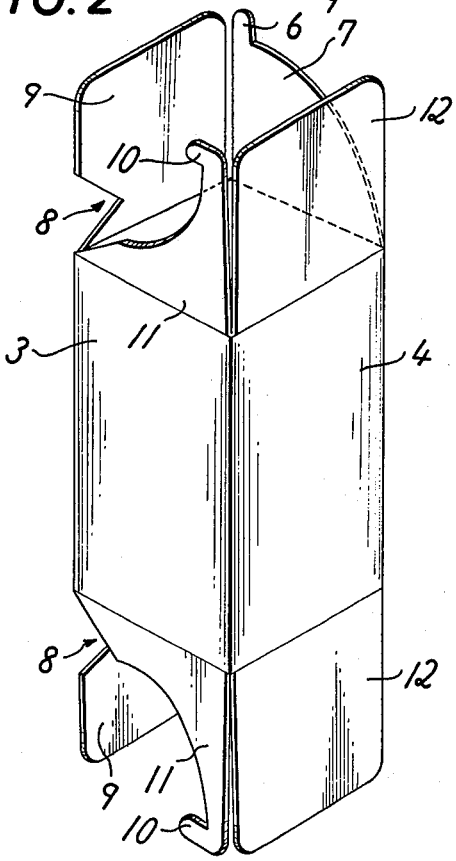

In the construction of the carton according to this invention, the panel 5 is pasted to the inner part of said panel 1 to form a carton shaped as shown in FIG. 2. Then, the locking flap 11 connected to the both ends of said panel are laterally folded respectively along the edge, said supporting flaps 7 are folded onto said locking flap 11, the projections 6 of said supporting flaps 7 are positioned at the angle portions 14 of the locking flap 11, and then the lower cover flaps are folded upon the supporting flaps 7. The projections 6 of supporting flaps 7 are pressed by lower cover flaps 9 so as to bring projection 6 more to the underside of the locking flap 11. In other words, the width of the side panel 2 is less than that of panel 3 and the lower cover flaps 9, affixed to side panel 2, are connected slightly nearer the center of the carton than is locking flap 11. That is, edge *f* is below edge *g* such that when the flaps 9 and 11 are folded, flap 9 pushes flap 11 slightly inward toward the inside of the carton. Accordingly, it is possible to push the projections 6 of supporting flaps 7 toward the inside, or center, of the carton automatically by folding the lower cover flaps 9 as shown especially in FIGS. 4 and 6. The construction of carton is completed by folding the upper cover flap 12 upon the lower cover flap 9 and pasting.

In using the carton of this invention, the side of the carton can be opened widely by cutting the perforated line d and then pulling the side panel 1 forward.

When the side panel 1 is pulled forward, as a cover, the projections 6 of the supporting flaps 7, connected to the side panel 1, come to the inside more than that of locking flap 11, and interlock with the locking flap 11, such that the supporting flaps 7 are moved with the movement of the side panel 1. The projections 6 slide along the edges of concave curves 13 and lock with projections 10 of said locking flap 11. Thus, it is capable of regulating the opening of the side panel 1.

Inasmuch as the carton according to this invention has the construction described above, it is possible to construct it automatically, using an automatic carton manufacturing machine.

I claim:

1. A carton construction comprising a first side panel, supporting flaps hingedly connected to said first side panel at each end thereof, said supporting flaps having a fan-shaped convex edge and a projection located adjacent the convex edge outermost from the hinged connection, a second side panel hingedly connected to said first side panel, lower cover flaps hingedly connected to said second side panel at each end thereof, said lower cover flaps having substantially rectangular edges and having a V-shaped cutout at one edge, said V-shaped cutout located adjacent the hinged connection between said second side panel and said lower cover flap, a third side panel hingedly connected to said second side panel, locking flaps hingedly connected to said third side panel at each end thereof, wherein the distance between the ends of said second side panel is less than the distance between the ends of said third side panel, said locking flaps having an angle portion at an edge opposite from the V-shaped cutout of said lower cover flaps, a concave portion extending from said angle portion, and a projection extending from said angle portion, a fourth side panel hingedly connected to said third side panel, upper cover flaps hingedly connected to said fourth side panel at each end thereof, said upper cover flaps having substantially rectangular edges, and a connecting panel hingedly connected to said fourth side panel.

2. The carton construction according to claim 1 wherein said supporting flaps are adapted to be folded over said locking flaps such that said projections of said supporting flaps are positioned directly above said angle portion of said locking flaps.

3. The carton construction of claim 2 wherein said lower cover flaps are adapted to be folded over said supporting flaps such that said lower cover flaps enable the projections of said supporting flaps to be positioned slightly inward of said angle portions.

* * * * *